US007992469B2

(12) United States Patent
Chang et al.

(10) Patent No.: US 7,992,469 B2
(45) Date of Patent: Aug. 9, 2011

(54) SCREW FEEDING DEVICE IN CONTINUOUS SCREW DRIVING TOOL

(75) Inventors: Shin-Nan Chang, Taichung (TW); Hung-Da Chen, Taichung (TW)

(73) Assignee: Basso Industry Corp., Taichung (TW)

( * ) Notice: Subject to any disclaimer, the term of this patent is extended or adjusted under 35 U.S.C. 154(b) by 122 days.

(21) Appl. No.: 12/432,275

(22) Filed: Apr. 29, 2009

(65) Prior Publication Data

US 2010/0275736 A1 Nov. 4, 2010

(51) Int. Cl.
*B25B 23/04* (2006.01)

(52) U.S. Cl. ..... 81/57.37

(58) Field of Classification Search ..... 81/57.37, 81/430, 433–435
See application file for complete search history.

(56) References Cited

U.S. PATENT DOCUMENTS

| | | | | |
|---|---|---|---|---|
| 5,988,025 | A | 11/1999 | Sasaki et al. | |
| 7,454,996 | B2 * | 11/2008 | Hsu | 81/57.37 |
| 2004/0112183 | A1 * | 6/2004 | Huang et al. | 81/434 |
| 2009/0314143 | A1 * | 12/2009 | Chen | 81/472 |

* cited by examiner

*Primary Examiner* — David B Thomas
(74) *Attorney, Agent, or Firm* — Leydig, Voit & Mayer, Ltd.

(57) ABSTRACT

A screw feeding device includes a feeder box, a stopper member, an operating member, and a resilient member. An adjustment slot is formed in the stopper member, and has two closed ends and alternate large-diameter and small-diameter slot portions. An operating protrusion of the operating member has a large-diameter protrusion portion and a small-diameter protrusion portion. The operating protrusion is biased by the resilient member away from the feeder box. The operating member is movable relative to the feeder box between a first position whereat the large-diameter protrusion portion is disposed within a selected one of the large-diameter slot portions, and a second position whereat the small-diameter protrusion portion is disposed in the adjustment slot.

18 Claims, 18 Drawing Sheets

SCREW FEEDING DEVICE IN CONTINUOUS SCREW DRIVING TOOL

BACKGROUND OF THE INVENTION

1. Field of the Invention

This invention relates to a continuous screw driving tool, and more particularly to a screw feeding device in a continuous screw driving tool.

2. Description of the Related Art

Referring to FIGS. 1, 2, and 3, a screw feeding device in a continuous screw driving tool disclosed in U.S. Pat. No. 5,988,025 includes a casing 1 mounted on a tool body of the continuous screw driving tool. A feeder box 2 is movable reciprocally within the casing 1, so that a screw carrying belt (not shown) is fed by a distance corresponding to one pitch of screws (not shown) carried thereon as the feeder box 2 is moved reciprocally by one stroke. A stopper base 3 is mounted on the feeder box 2, and a mounting mechanism is provided for mounting the stopper base 3 on the feeder box 2, so that the stopper base 3 can be changed in its position relative to the feeder box 2. The mounting mechanism includes a plurality of lock holes 302 and a lock member 4. The lock holes 302 are formed in the stopper base 3. Any adjacent two lock holes 302 are spaced apart from each other by a predetermined distance in a screw driving direction (X). The lock member 4 is movable within a vertical slide slot 202 in the feeder box 2 in a vertical direction (Z), and has a lock protrusion 403 engageable with a selected one of the lock holes 302 and held in position in the screw driving direction (X) relative to the feeder box 2.

The screw feeding device suffers from the following disadvantages:

(1) The stopper base 3 is formed with a plurality of sliding members 301 engaging respectively and movably a plurality of open-ended horizontal slide slots 201 in the feeder box 2. As such, when the lock member 4 is pressed in the vertical direction (Z) to remove the lock protrusion 403 from the selected lock hole 302, unintentional removal of the stopper base 3 from the feeder box 2 may occur. Furthermore, if the unintentional removal of the stopper base 3 occurs, two compression springs 5 will jump and drop from the feeder box 2, thereby resulting in inconvenience during use.

(2) Since any adjacent two lock holes 302 are spaced apart from each other by the predetermined distance, as described above, the number of the lock holes 302 is limited. As a result, the applicable range of the continuous screw driving tool is also limited.

(3) Visual inspection of the screws is not permissible during the screw driving operation due to the fact that screw-discharging hole 203 and lateral side surfaces of the feeder box 2 are shielded by the stopper base 3. To facilitate alignment of the screws, a central slot unit 304 is provided at the stopper base 3, and is in spatial communication with a screw feeding hole 303 in the stopper base 3, thereby further resulting in inconvenience during use and reducing the alignment precision.

SUMMARY OF THE INVENTION

The object of this invention is to provide a screw feeding device in a continuous screw driving tool that can overcome the above-mentioned disadvantages associated with the prior art.

According to this invention, a screw feeding device includes a feeder box, a stopper member, an operating member, and a resilient member. An adjustment slot is formed in the stopper member, and has two closed ends and alternate large-diameter and small-diameter slot portions. An operating protrusion of the operating member has a large-diameter protrusion portion and a small-diameter protrusion portion. The operating protrusion is biased by the resilient member away from the feeder box such that, the operating member is movable relative to the feeder box between a first position whereat the large-diameter protrusion portion is disposed within a selected one of the large-diameter slot portions, and a second position whereat the small-diameter protrusion portion is disposed in the adjustment slot.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
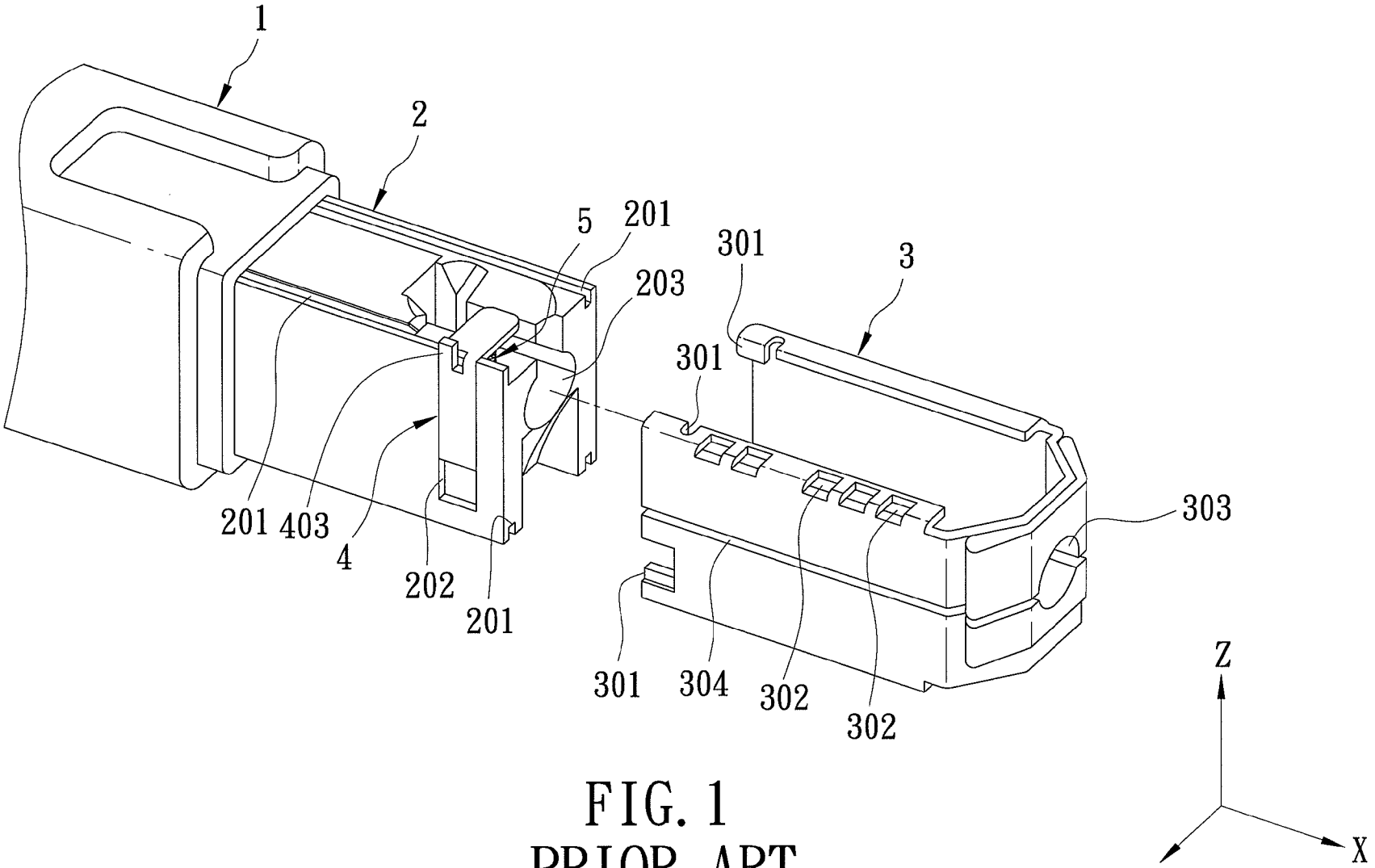
FIG. 1 PRIOR ART
FIG. 1 is a partly exploded perspective view of a conventional screw feeding device in a continuous screw driving tool disclosed in U.S. Pat. No. 5,988,025.
Figure 2:
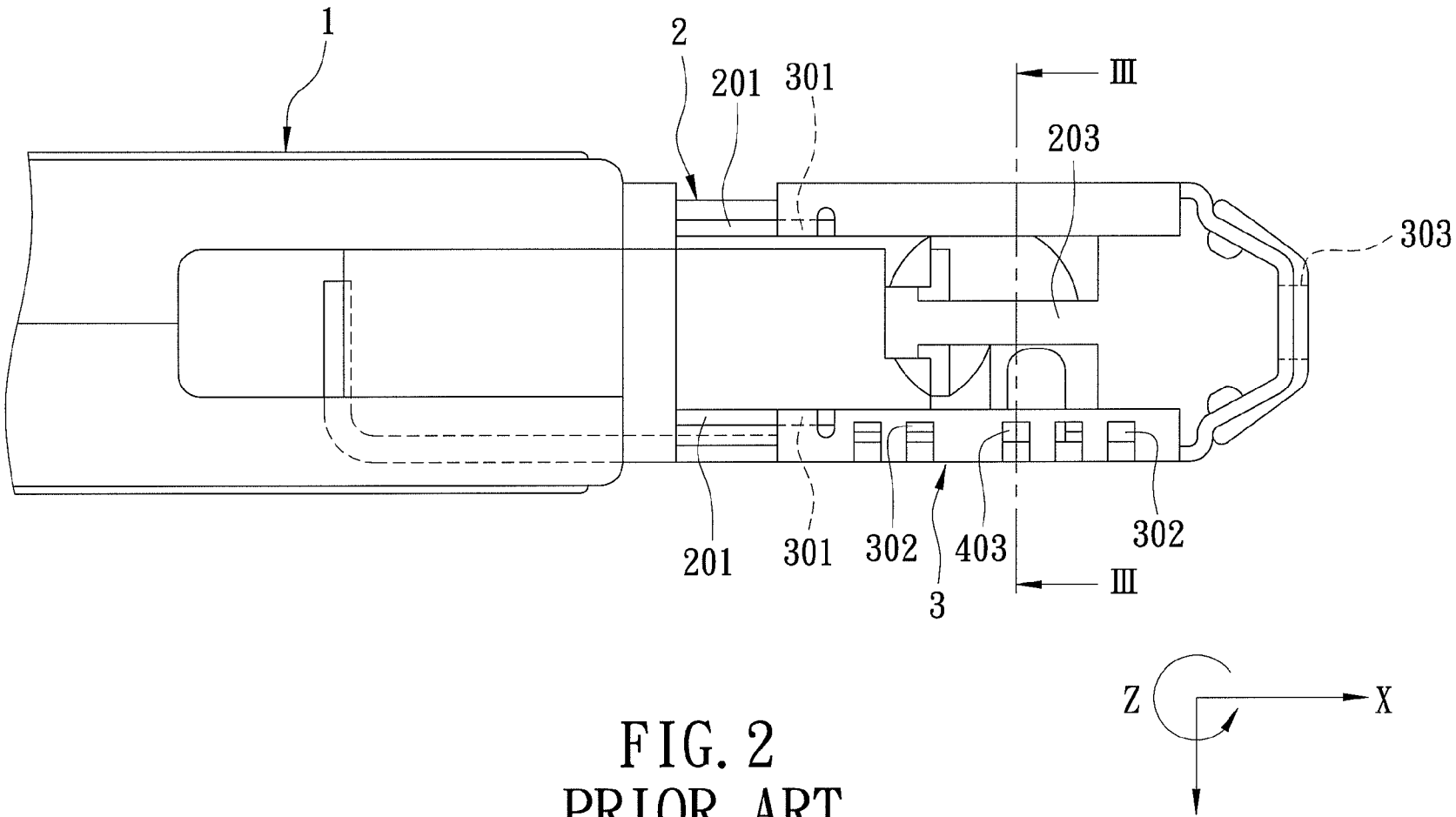
FIG. 2 PRIOR ART
FIG. 2 is a schematic top view of the conventional screw feeding device.
Figure 3:
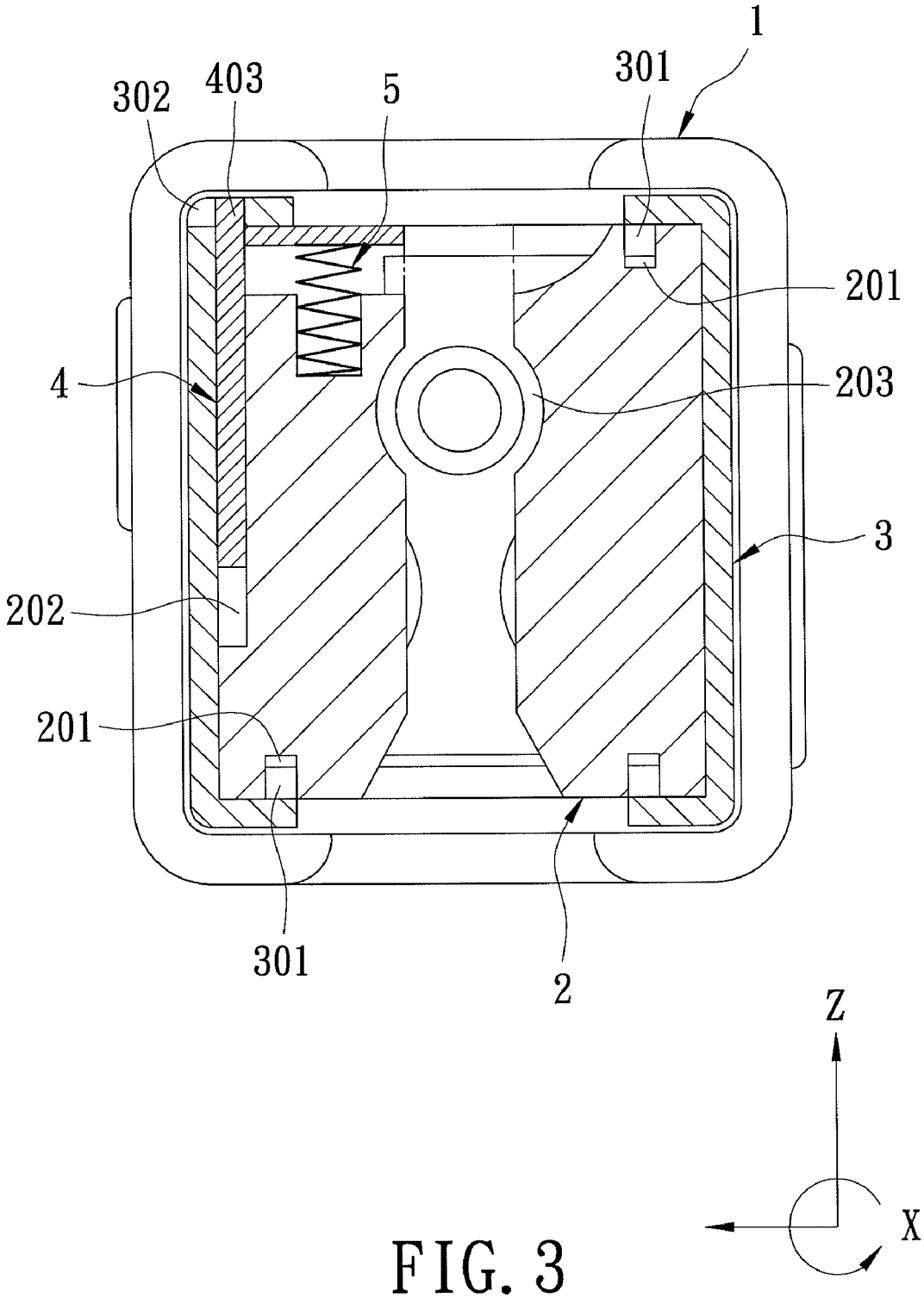
FIG. 3 PRIOR ART
FIG. 3 is a schematic sectional view taken along line III-III in FIG. 2.

Before the present invention is described in greater detail in connection with the preferred embodiments, it should be noted that similar elements and structures are designated by like reference numerals throughout the entire disclosure.

Figure 4:
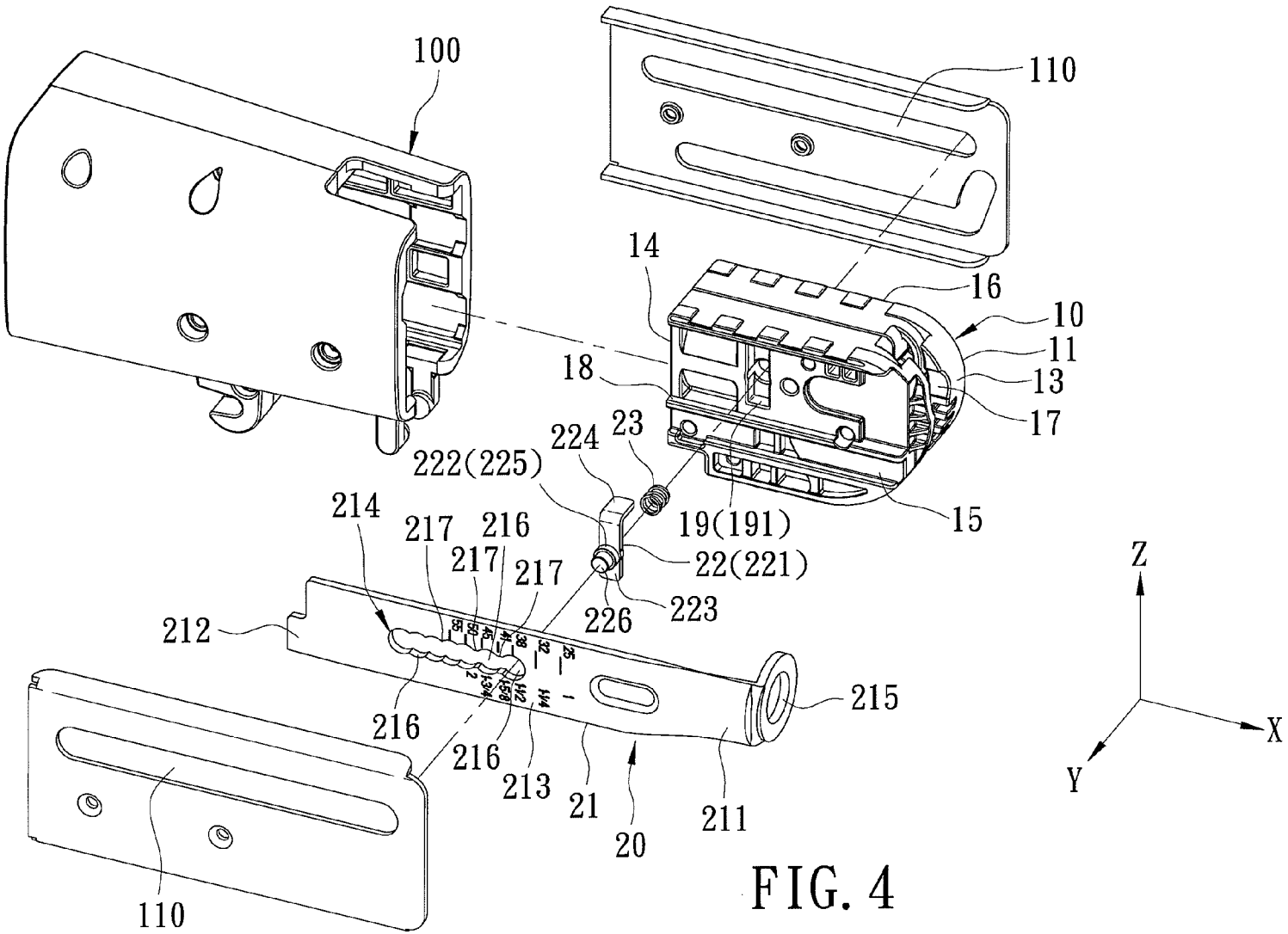
FIG. 4 is an exploded perspective view of the first preferred embodiment of a screw feeding device in a continuous screw driving tool according to this invention.
Figure 5:
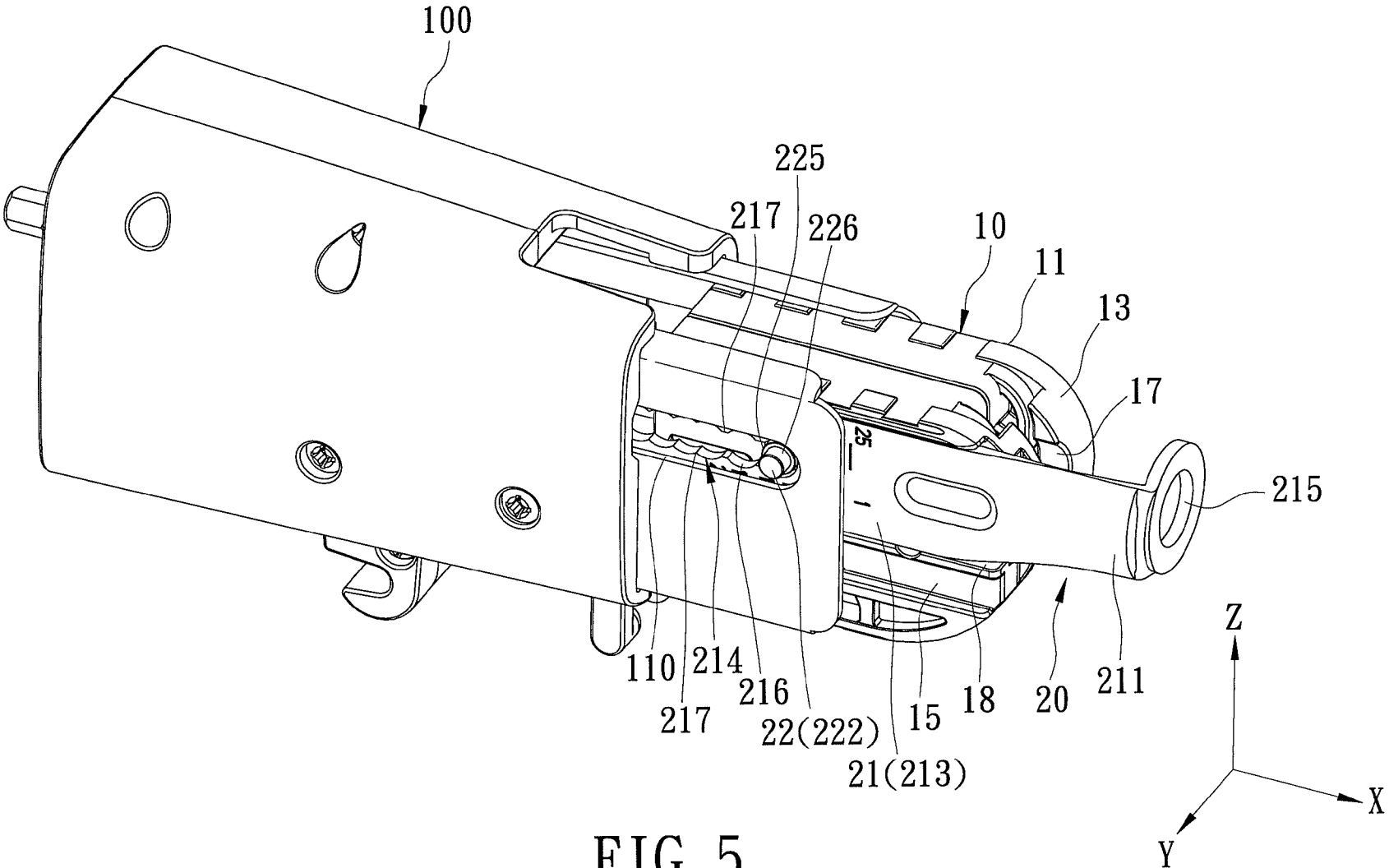
FIG. 5 is an assembled perspective view of the first preferred embodiment.
Figure 6:
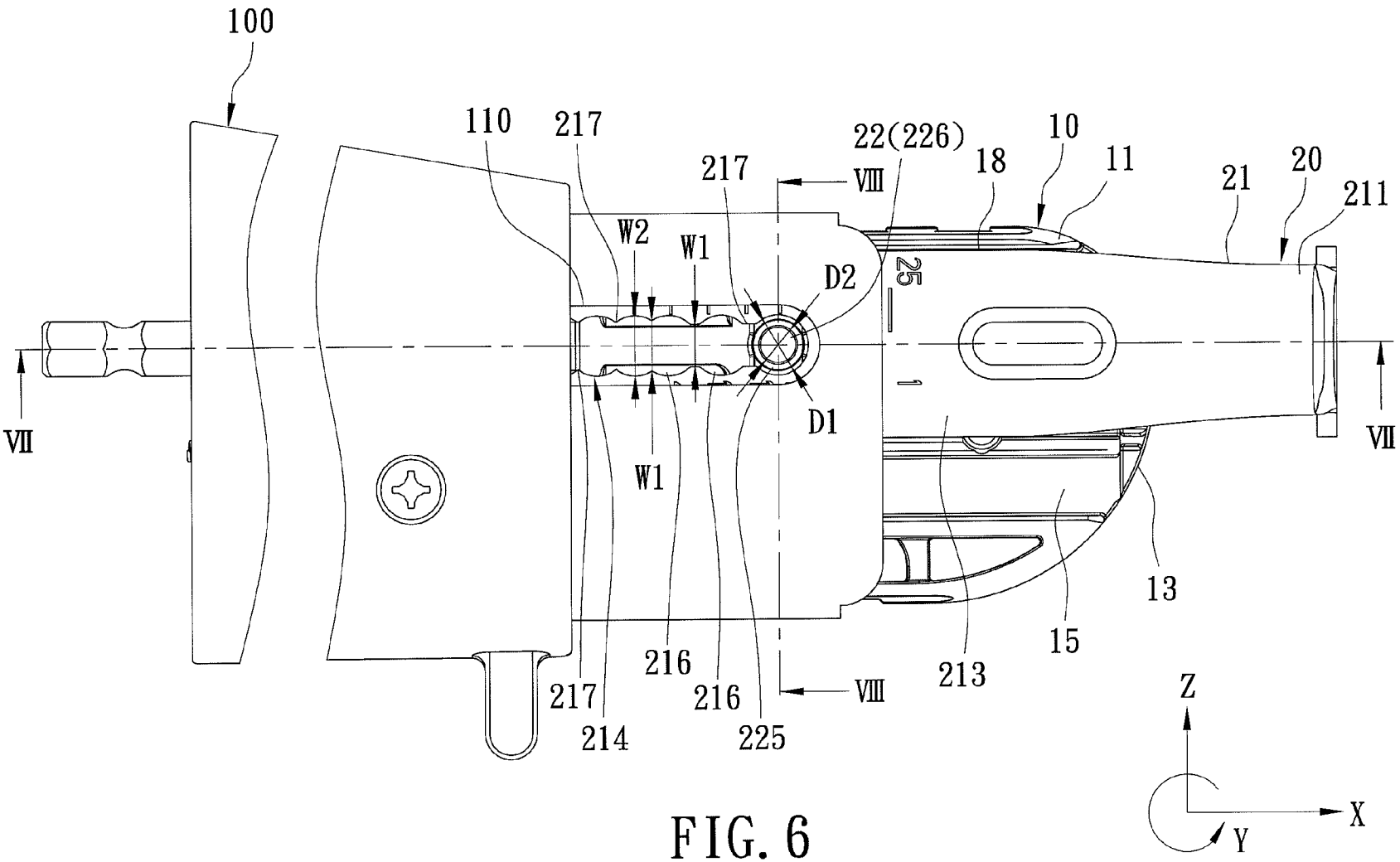
FIG. 6 is a schematic side view of the first preferred embodiment.

Referring to FIGS. 4, 5, and 6, the first preferred embodiment of a screw feeding device according to this invention is disposed in a tool body 100 of a continuous screw driving tool. The tool body 100 extends in an axial direction (X), and includes a pair of parallel first and second guide slots 110 extending in the axial direction (X). The screw feeding device includes a feeder box mechanism 10 and a lock mechanism 20.

Figure 7:
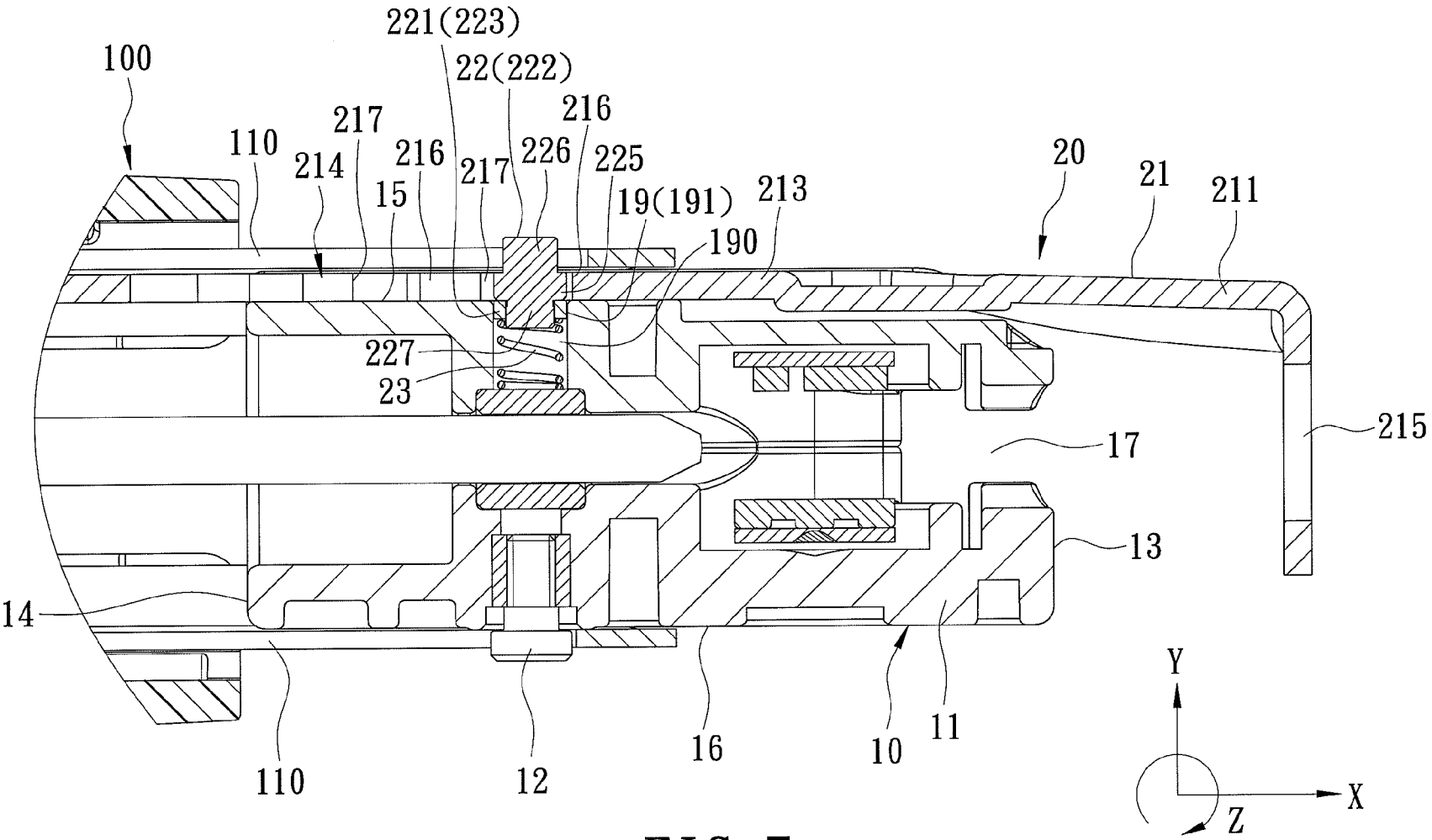
FIG. 7 is a schematic sectional view taken along line VII-VII in FIG. 6, illustrating an operating member in a first position.
Figure 8:
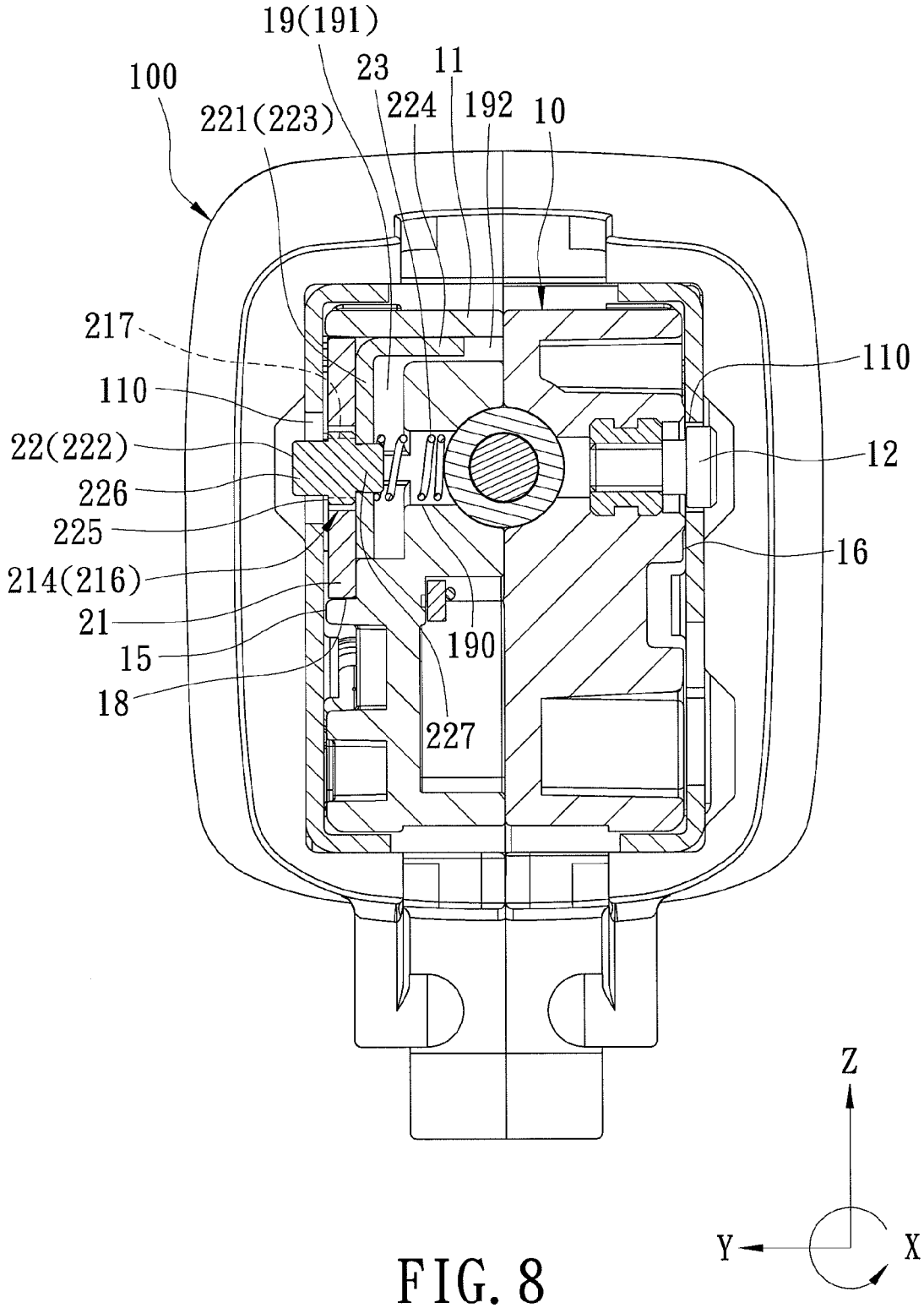
FIG. 8 is a schematic view taken along line VIII-VIII in FIG. 6, illustrating the operating member in the first position.

With further reference to FIGS. 7 and 8, the feeder box mechanism 10 is movable within the tool body 100 in the axial direction (X), and includes a feeder box 11 and a guide pin 12 disposed fixedly on the feeder box 11. The feeder box 11 has a front end surface 13, a rear end surface 14, a first lateral side surface 15, a second lateral side surface 16 opposite to the first lateral side surface 15 in a transverse direction (Y) perpendicular to the axial direction (X), a screw-discharging hole 17 extending rearwardly from the front end surface 13 in the axial direction (X), a slide slot 18 formed in the first lateral side surface 15 and extending in the axial direction (X), a mounting groove 19 formed in the first lateral side surface 15 and in spatial communication with the slide slot 18, and a receiving hole 190 in spatial communication with and extending from mounting groove 19 in the transverse direction (Y). The mounting groove 19 has a vertical groove portion 191 and a horizontal groove portion 192 extending from an upper end of the vertical groove portion 191 in the transverse direction (Y). The guide pin 12 is disposed on the second lateral side surface 16, and extends through the first guide slot 110 in the tool body 100.

The lock mechanism 20 includes a stopper member 21 movable within the slide slot 18 in the feeder box 11 in the axial direction (X), an operating member 22 movable within the mounting groove 19 in the feeder box 11 in the transverse direction (Y), and a resilient member 23 disposed between the operating member 22 and the feeder box 11.

The stopper member 21 has a first end portion 211, a second end portion 212 opposite to the first end portion 211 in the axial direction (X), an intermediate section 213 connected between the first and second end portions 211, 212 and extending in the axial direction (X), an adjustment slot 214 formed in the intermediate section 213 and extending in the axial direction (X), and a screw feeding hole 215 having a center aligned with that of the screw-discharging hole 17 in the feeder box 11 in the axial direction (X). The adjustment slot 214 has two closed ends opposite to each other in the axial direction (X), a plurality of large-diameter slot portions 216 arranged in the axial direction, and a plurality of small-diameter slot portions 217 arranged alternately with the large-diameter slot portions 216 and each having a diameter (W1) (see FIG. 6) smaller than the diameter (W2) (see FIG. 6) of each of the large-diameter slot portions 216.

The operating member 22 has a base portion 221 disposed movably within the mounting groove 19, and an operating protrusion 222 extending through the adjustment slot 214 in the stopper member 21 in the transverse direction (Y). The operating protrusion 222 is biased by the resilient member 23 away from the feeder box 11. The operating member 22 is movable relative to the feeder box 11 between a first position shown in FIGS. 7 and 8 and a second position shown in FIGS. 9 and 10.

The base portion 221 has a vertical section 223 disposed within the vertical groove portion 191 of the mounting groove 19, and a horizontal section 224 extending from an upper end of the vertical section 223 and disposed within the horizontal groove portion 192 of the mounting groove 19.

The operating protrusion 222 has a large-diameter protrusion portion 225 and a small-diameter protrusion portion 226 farther from the base portion 221 than the large-diameter protrusion portion 225, and a connecting portion 227 extending from the large-diameter protrusion portion 225 into the resilient member 23 in the transverse direction (Y) and away from the small-diameter protrusion portion 226. When the operating member 22 is disposed in the first position, the small-diameter protrusion portion 226 extends through the second guide slot 110 in the tool body 100. The connecting portion 227 is fixed within a hole in the vertical section 223 of the base portion 221 by riveting.

The large-diameter protrusion portion 225 has a diameter (D1) (see FIG. 6) no larger than the diameter (W2) of each of the large-diameter slot portions 216 and larger than the diameter (W1) of each of the small-diameter slot portions 217. The small-diameter protrusion portion 226 has a diameter (D2) (see FIG. 6) smaller than that of the large-diameter protrusion portion 225 and no larger than the diameter (W1) of each of the small-diameter slot portions 217.

The resilient member 23 is disposed within the receiving hole 190 in the feeder box 11 for applying a pushing force to the vertical section 223 of the base portion 221 of the operating member 21 in the transverse direction (Y). In this embodiment, the resilient member 23 is configured as a coiled compression spring.

With particular reference to FIGS. 5, 7, and 8, when the operating member 22 is disposed in the first position, the large-diameter protrusion portion 225 is disposed within a selected one of the large-diameter slot portions 216. As such, since the diameter (D1) of the large-diameter protrusion portion 225 is larger than the diameter (W1) of each of the small-diameter slot portions 217, removal of the large-diameter protrusion portion 225 from the selected large-diameter slot portion 216 can be prevented.

Figure 9:
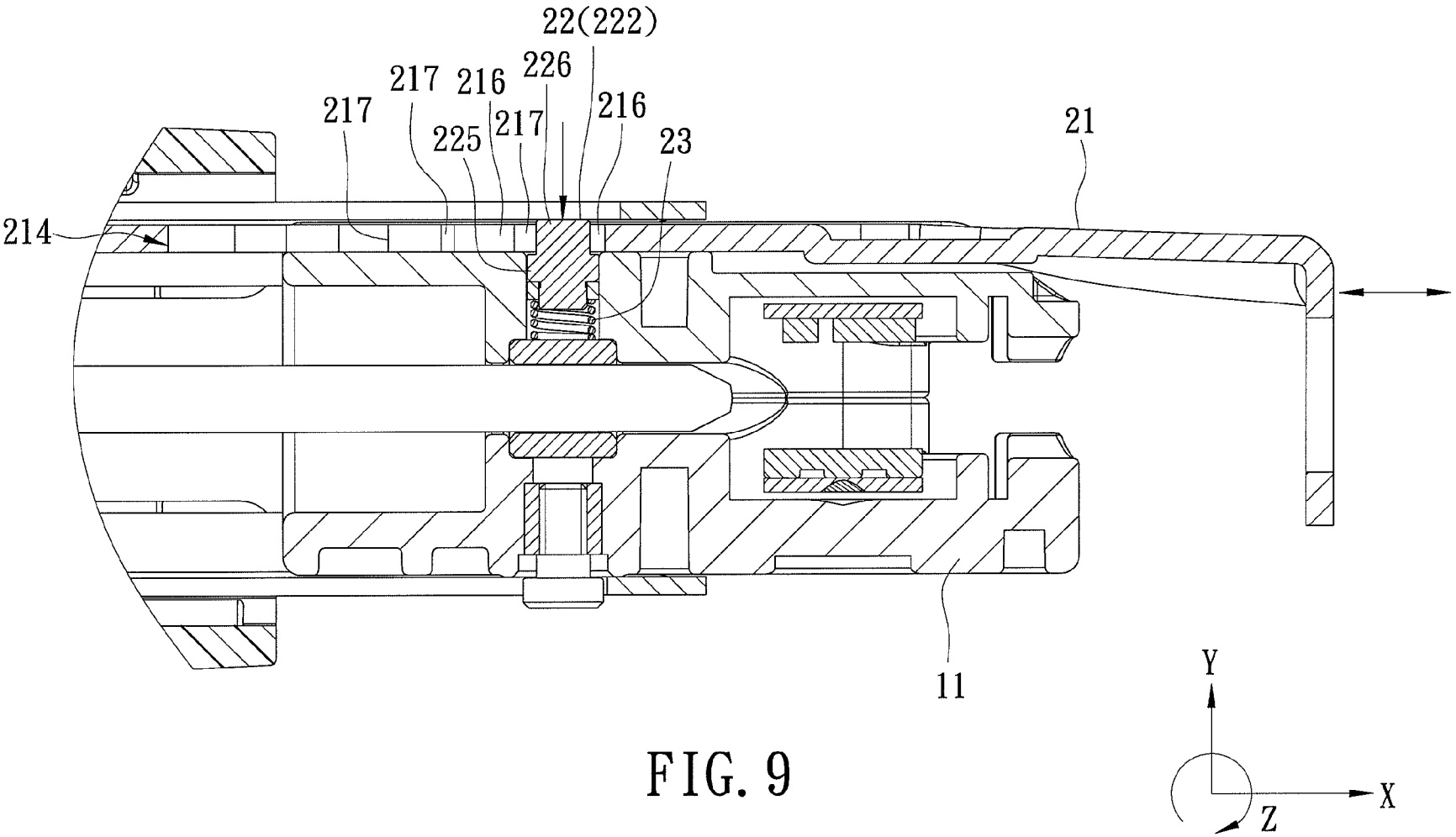
FIG. 9 is a view similar to FIG. 7 but illustrating the operating member in a second position.
Figure 10:
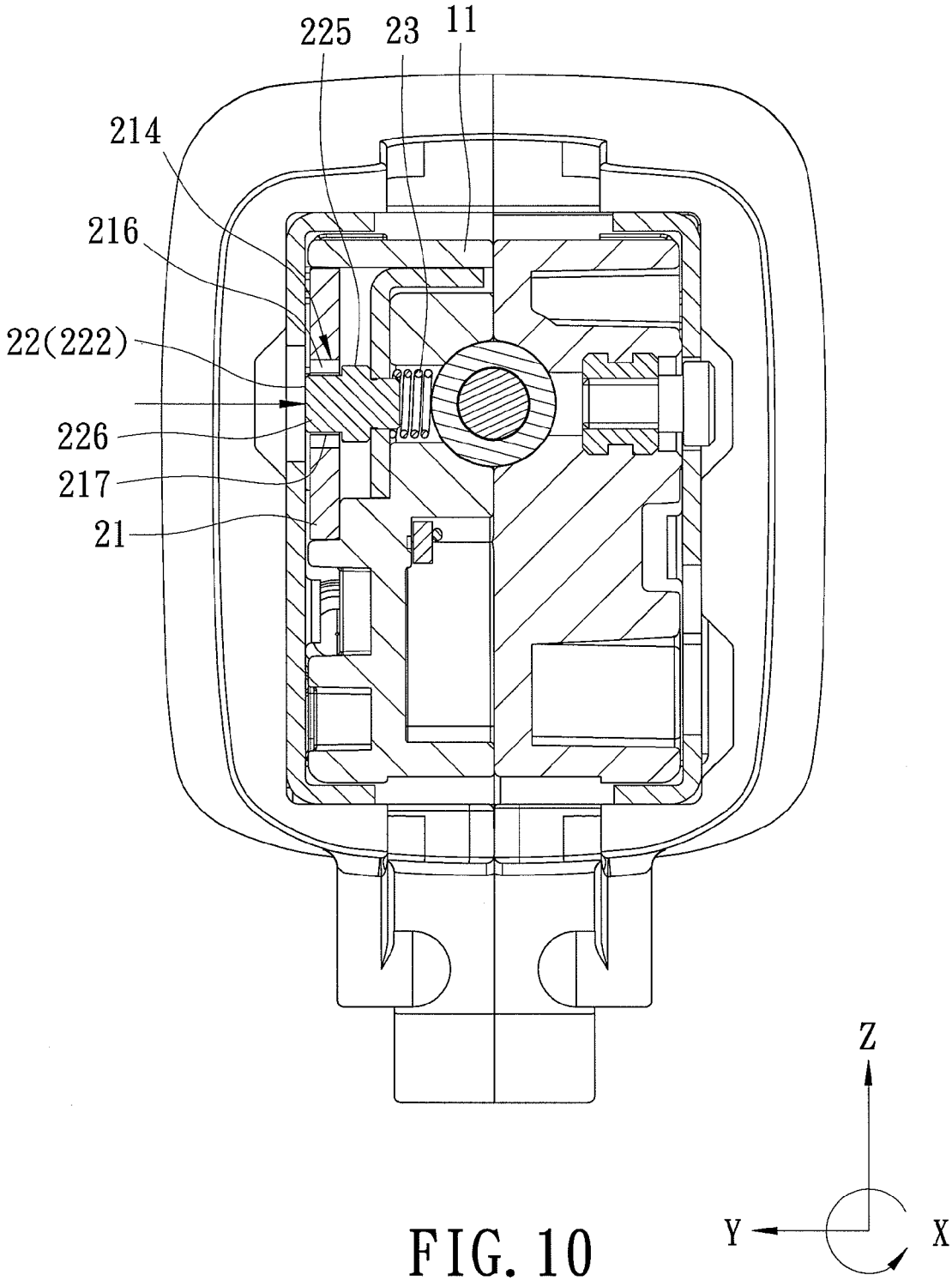
FIG. 10 is a view similar to FIG. 8 but illustrating the operating member in the second position.

With particular reference to FIGS. 9 and 10, when a screw-driving operation is desired such that position adjustment of the stopper member 21 relative to the feeder box 11 is required, the small-diameter protrusion portion 226 is pressed to remove the large-diameter protrusion portion 225 from the selected large-diameter slot portion 216 so that the small-diameter protrusion portion 226 is disposed within the selected large-diameter slot portion 216. At this time, since the diameter (D2) of the small-diameter protrusion portion 226 is no larger than the diameter (W1) of each of the small-diameter slot portions 217, the stopper member 21 is movable to a desired position relative to the feeder box 11. After the stopper member 21 is moved to the desired position, the small-diameter protrusion portion 226 is released to allow the operating member 22 to be biased by the resilient member 23 to move into another large-diameter slot portion 216 corresponding to the desired position.

In view of the foregoing, the screw feeding device of this invention has the following advantages:

(1) Since the operating protrusion 222 of the operating member 22 is confined within the adjustment slot 214 in the stopper member 21 whether the operating member 22 is disposed in the first or second position, the stopper member 21 cannot separate from the operating member 22 and, thus, the feeder box 11. That is, unintentional removal of the stopper member 21 from the feeder box 11 can be prevented.

(2) Due to alternate arrangement of the large-diameter and small-diameter slot portions 216, 217, any adjacent two large-diameter slot portions 216 can be spaced apart from each other by a relatively small distance, thereby increasing the number of the large-diameter slot portions 216 in an axial length of the stopper member 21. Hence, the applicable range of the screw feeding device is increased. In other words, the screw feeding device can be used to feed various types of screws having different lengths corresponding to the large-diameter slot portions 216, respectively.

(3) The second lateral side surface 16 and the screw-discharging hole 17 of the feeder box 11 are disposed outwardly of the stopper member 21. Thus, visual inspection of the screws is permissible during the screw driving operation so that the central slot unit 304 (see FIG. 1) of the above-mentioned prior art can be omitted.

Figure 11:
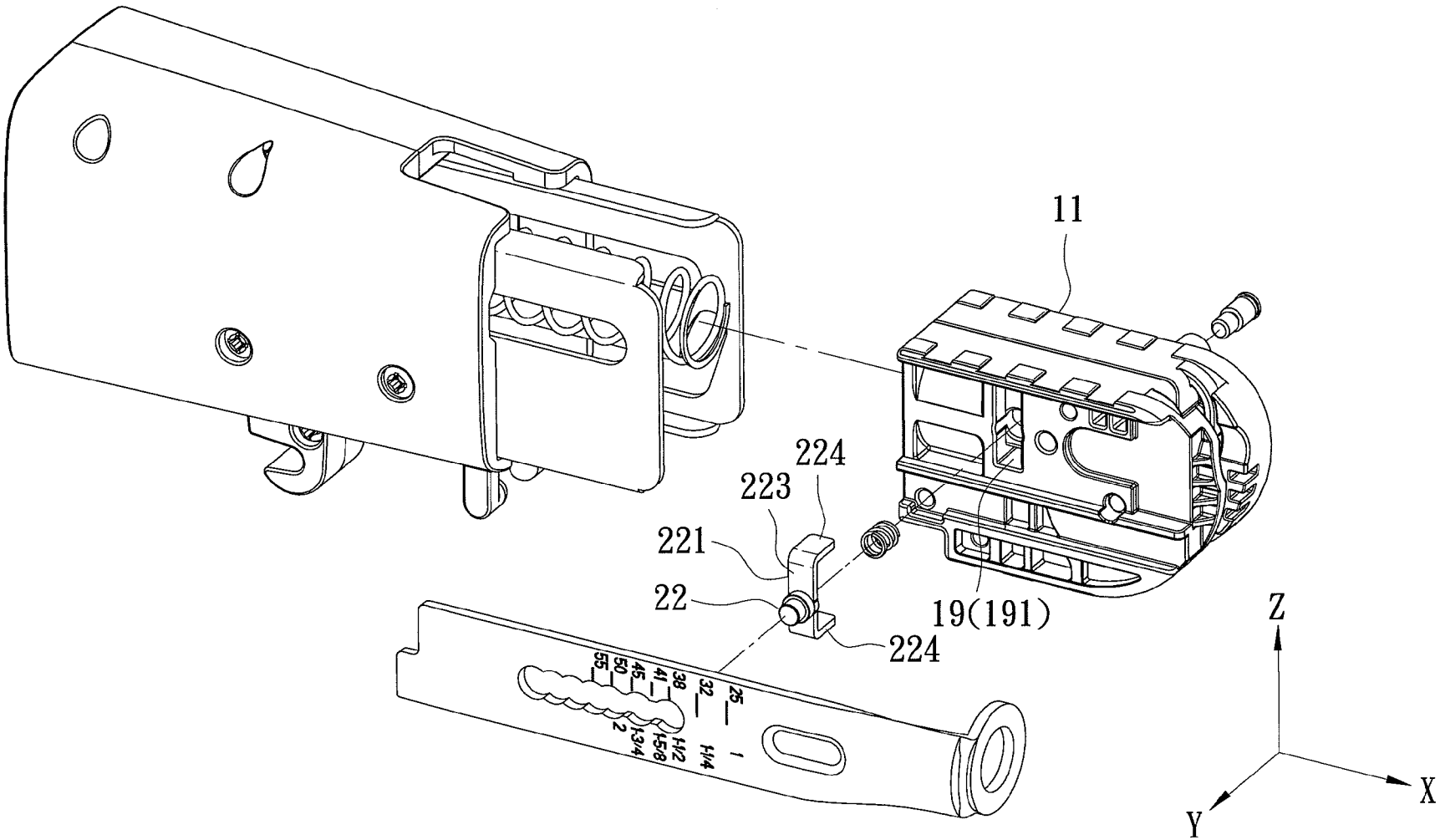
FIG. 11 is an exploded perspective view of the second preferred embodiment of a screw feeding device in a continuous screw driving tool according to this invention.
Figure 12:
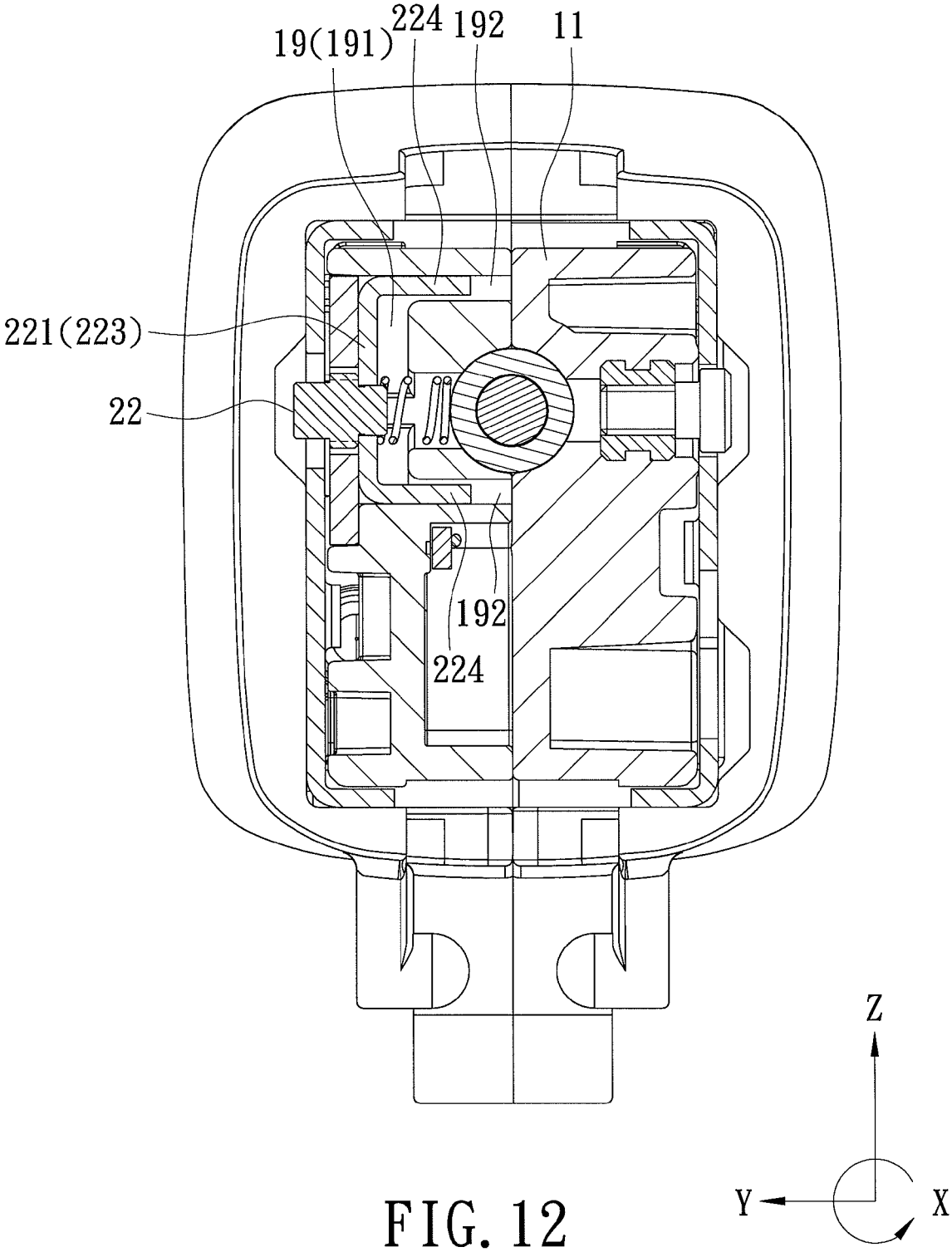
FIG. 12 is a schematic sectional view of the second preferred embodiment, illustrating an operating member in a first position.

FIGS. 11 and 12 show the second preferred embodiment of a screw feeding device in a continuous screw driving tool according to this invention, which is similar in construction to the first preferred embodiment.

In this embodiment, the mounting groove 19 in the feeder box 11 has a vertical groove portion 191 and two parallel horizontal groove portions 192 extending respectively from two opposite ends of the vertical groove portion 191 in the transverse direction (Y). The base portion 221 of the operating member 22 has a vertical section 223 disposed within the vertical groove portion 191, and two horizontal sections 224 extending respectively from two opposite ends of the vertical section 223 and disposed respectively within the horizontal groove portions 192.

As such, the second preferred embodiment can achieve the same object as the first preferred embodiment.

Figure 13:
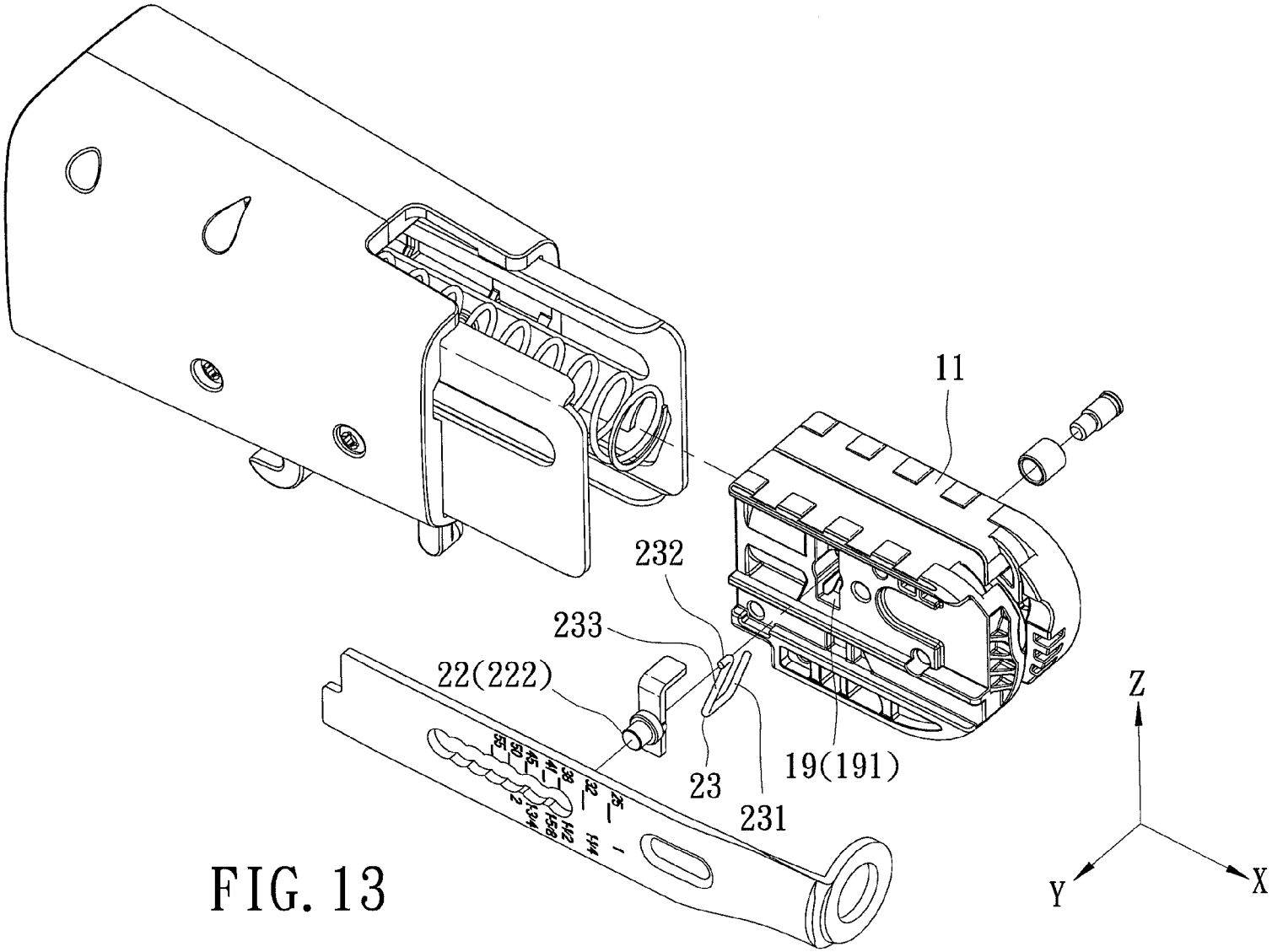
FIG. 13 is an exploded perspective view of the third preferred embodiment of a screw feeding device in a continuous screw driving tool according to this invention.
Figure 14:
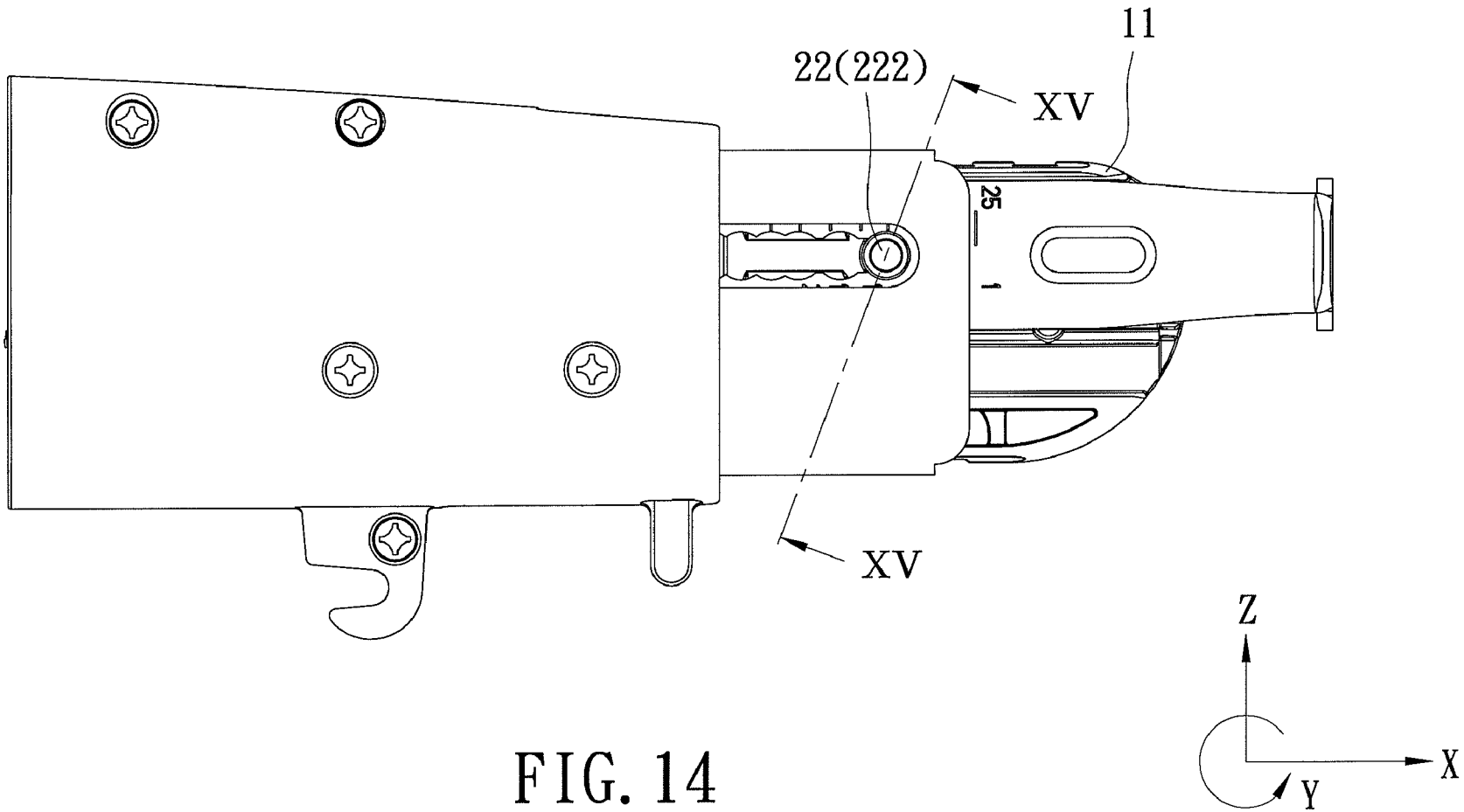
FIG. 14 is a schematic side view of the third preferred embodiment.
Figure 15:
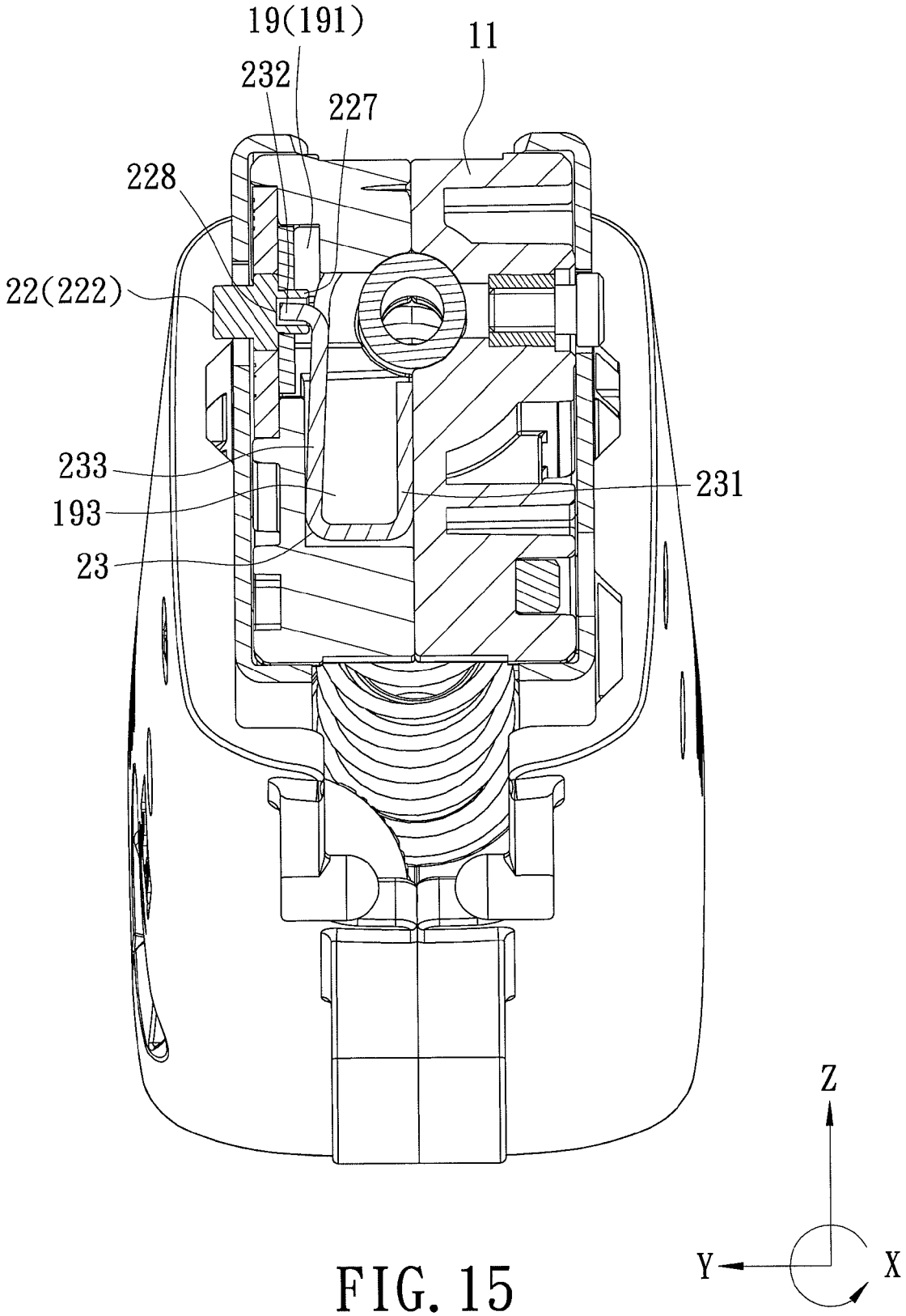
FIG. 15 is a schematic sectional view taken along line XV-XV in FIG. 14, illustrating an operating member in a first position.

FIGS. 13, 14, and 15 show the third preferred embodiment of a screw feeding device in a continuous screw driving tool according to this invention, which is similar in construction to the first preferred embodiment.

In this embodiment, the feeder box 11 has a recess 193 in spatial communication with and aligned with the vertical groove portion 191 of the mounting groove 19 in the transverse direction (Y).

The operating protrusion 222 of the operating member 22 is formed with a retaining groove 228 in the connecting portion 227.

The resilient member 23 has a first contact end 231 extending into the recess 193 in the feeder box 11 and abutting against a wall defining the recess 193, a second contact end 232 extending into the retaining groove 228 in the connecting portion 227 and pressing against the operating member 22, and a deformable section 233 connected between the first and second contact ends 231, 232. The resilient member 23 is in the form of a spring bar. When the operating member 22 is pressed to move to the second position, the second contact end 232 is moved toward the first contact end 231 to flex the deformable section 233 to thereby store a return force. When released, the operating member 22 is returned to the first position due to the return force.

The third preferred embodiment can also achieve the same object of this invention as the first preferred embodiment.

Figure 16:
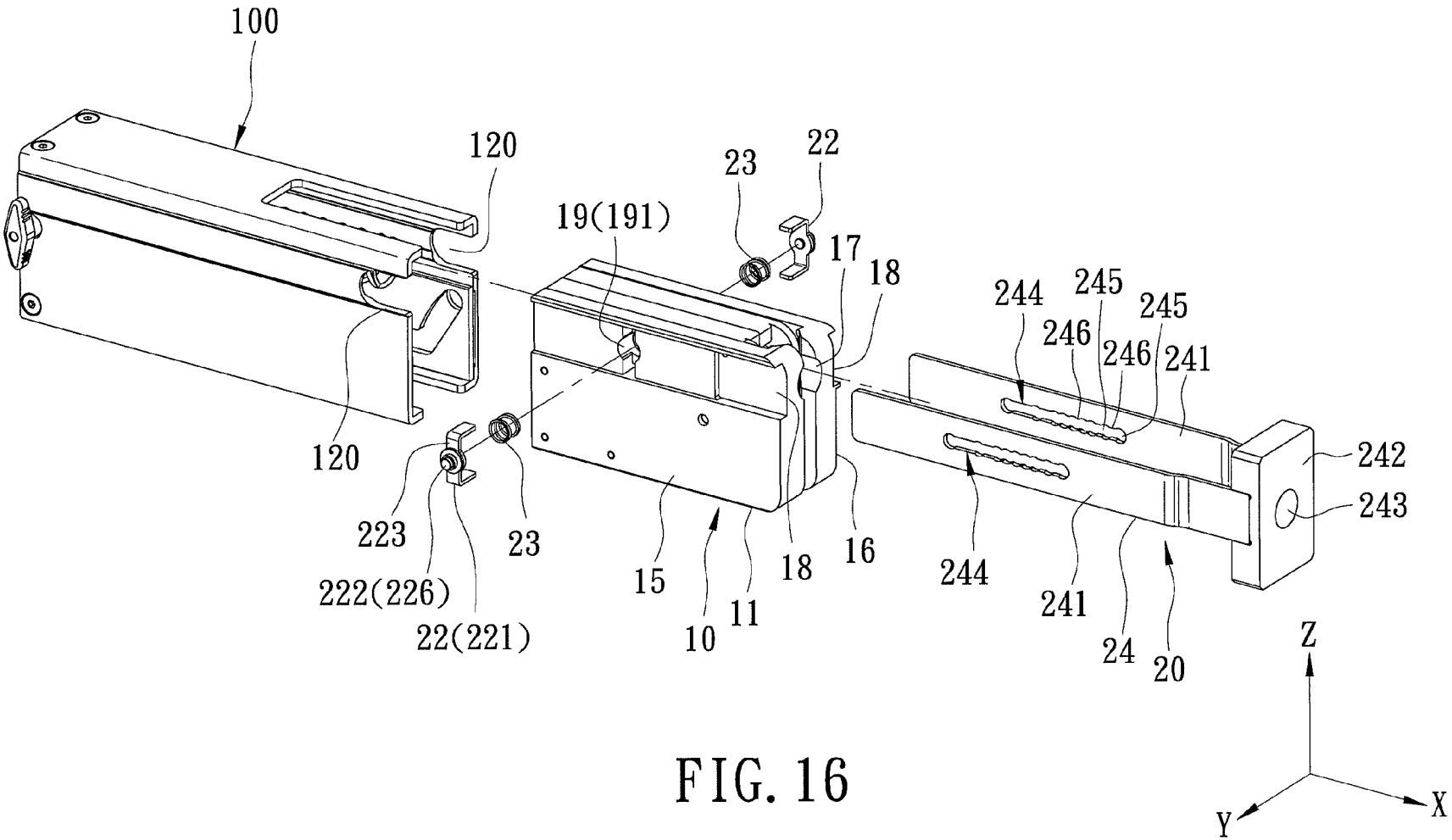
FIG. 16 is an exploded perspective view of the fourth preferred embodiment of a screw feeding device in a continuous screw driving tool according to this invention.
Figure 17:
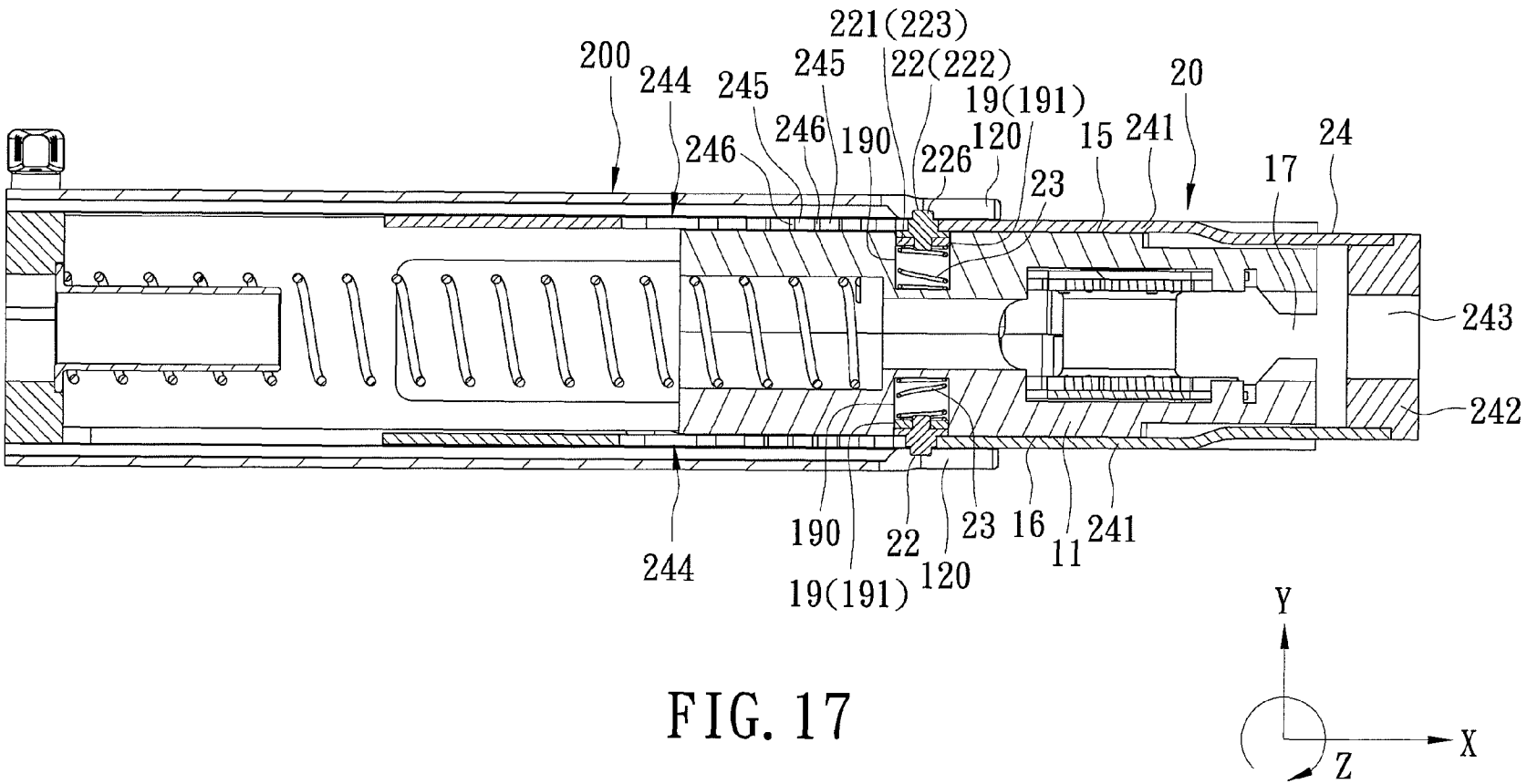
FIGS. 17 and 18 are schematic sectional views of the fourth preferred embodiment, illustrating an operating member in a first position.
Figure 18:
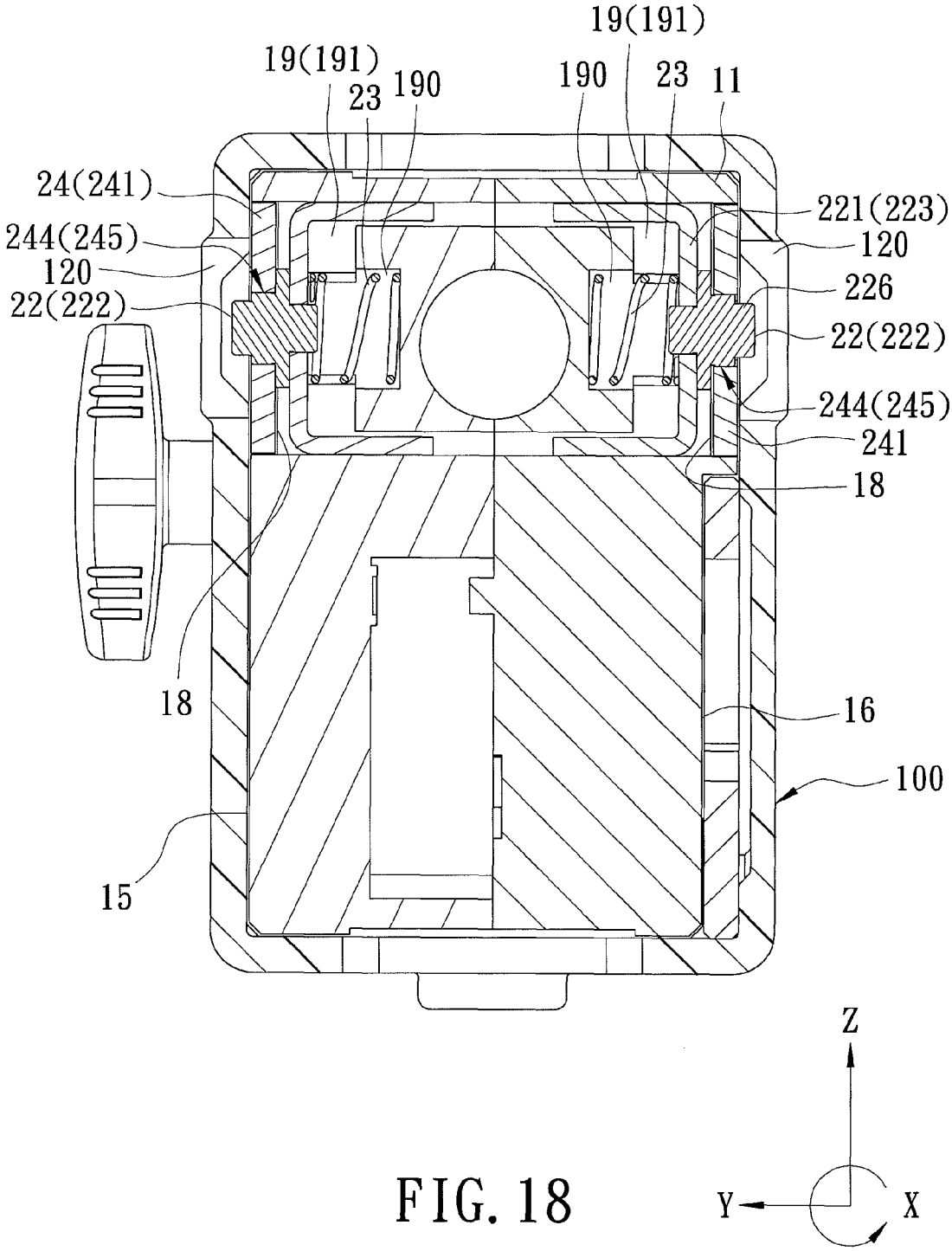

FIGS. 16, 17, and 18 show the fourth preferred embodiment of a screw feeding device in a continuous screw driving tool according to this invention, which is similar in construction to the second preferred embodiment.

In this embodiment, the tool body 100 has two lateral side walls formed respectively with two aligned notches 120 at front ends thereof.

The feeder box 11 of the feeder box mechanism 10 has two slide slots 18 formed respectively in the first and second lateral side surfaces 15, 16 and extending in the axial direction (X), two mounting grooves 19 formed respectively in the first and second lateral side surfaces 15, 16, and two receiving holes 190 extending respectively from the vertical groove portions 191 of the mounting grooves 19 in the feeder box 11 in the transverse direction (Y).

The lock mechanism 10 includes a stopper member 24 movable on the first and second lateral side surfaces 15, 16 of the feeder box 11 in the axial direction (X), two operating members 22 movable respectively within the mounting grooves 19 in the feeder box 11 in the transverse direction (Y), and two resilient members 23 each disposed between a respective one of the operating members 22 and the feeder box 11.

When each of the operating members 22 is disposed in the first position, as shown in FIG. 18, the small-diameter protrusion portions 226 of the operating protrusions 222 extend respectively into the notches 120 in the tool body 100.

The resilient members 23 are disposed respectively within the receiving holes 190. Each of the resilient members 23 applies a pushing force to the vertical section 223 of the base portion 221 of the corresponding operating member 22 in the transverse direction (Y).

The stopper member 24 includes two spaced-apart parallel sliding strips 241 extending in the axial direction and having aligned front ends, an abutment block 242 connected between the front ends of the sliding strips 241, a screw feeding hole 243 having a center aligned with that of the screw-discharging hole 17 in the feeder box 11 in the axial direction (X), and two adjustment slots 244 formed respectively in the sliding strips 241 and extending in the axial direction (X).

The sliding strips 241 are disposed respectively and movably within the slide slots 18 in the feeder box 11.

Each of the adjustment slots 244 has two closed ends opposite to each other in the axial direction (X), and a plurality of alternate large-diameter and small-diameter slot portions 245, 246.

The fourth preferred embodiment can also achieve the same object of this invention as the first preferred embodiment.

With this invention thus explained, it is apparent that numerous modifications and variations can be made without departing from the scope and spirit of this invention. It is therefore intended that this invention be limited only as indicated by the appended claims.

We claim:

1. A screw feeding device adapted to be disposed in a tool body of a continuous screw driving tool, the tool body extending in an axial direction, said screw feeding device comprising:

a feeder box mechanism adapted to be disposed in the tool body and including a feeder box having a front end surface, a rear end surface, a first lateral side surface, a second lateral side surface opposite to said first lateral side surface, a screw-discharging hole extending rearwardly from said front end surface, and a mounting groove formed in said first lateral side surface; and a lock mechanism including a stopper member movable on said first lateral side surface of said feeder box in the axial direction, an operating member movable within said mounting groove in said feeder box in a transverse direction perpendicular to the axial direction, and a resilient member disposed between said operating member and said feeder box, said stopper member having an adjustment slot extending in the axial direction, said adjustment slot having two closed ends opposite to each other in the axial direction, a plurality of large-diameter slot portions arranged in the axial direction, and a plurality of small-diameter slot portions arranged alternately with said large-diameter slot portions and each having a diameter smaller than that of each of said large-diameter slot portions, said operating member having a base portion disposed movably within said mounting groove, and an operating protrusion extending through said adjustment slot in said stopper member in the transverse direction, said operating protrusion of said operating member having a large-diameter protrusion portion and a small-diameter protrusion portion farther from said base portion than said large-diameter protrusion portion, said large-diameter protrusion portion having a diameter no larger than that of each of said large-diameter slot portions and larger than that of each of said small-diameter slot portions, said small-diameter protrusion portion having a diameter smaller than that of said large-diameter protrusion portion and no larger than that of each of said small-diameter slot portions, said operating protrusion being biased by said resilient member away from said feeder box, said operating member being movable relative to said feeder box between a first position whereat said large-diameter protrusion portion is disposed within a selected one of said large-diameter slot portions, and a second position whereat said small-diameter protrusion portion is disposed in said adjustment slot; wherein said mounting groove in said feeder box has a vertical groove portion and a horizontal groove portion extending from an upper end of said vertical groove portion in the transverse direction, said base portion of said operating member having a vertical section disposed within said vertical groove portion, and a horizontal section extending from an upper end of said vertical section and disposed within said horizontal groove portion.

2. The screw feeding device as claimed in claim 1, wherein said feeder box further has a receiving hole extending from said vertical groove portion in the transverse direction, said resilient member being disposed within said receiving hole for applying a pushing force to said vertical section of said base portion of said operating member in the transverse direction.

3. The screw feeding device as claimed in claim 1, wherein said resilient member is configured as a coiled compression spring.

4. The screw feeding device as claimed in claim 1, wherein said operating protrusion of said operating member further has a connecting portion extending from said large-diameter protrusion portion into said resilient member in the transverse direction and away from said small-diameter protrusion portion.

5. The screw feeding device as claimed in claim 1, wherein said feeder box further has a recess in spatial communication with said vertical groove portion in the transverse direction, said operating protrusion of said operating member further having a connecting portion extending from said large-diameter protrusion portion in the transverse direction and away from said small-diameter protrusion portion, said connecting portion being formed with a retaining groove, said resilient member having a first contact end extending into said recess in said feeder box, a second contact end extending into said retaining groove and pressing against said operating member, and a deformable section connected between said first and second contact ends.

6. The screw feeding device as claimed in claim 1, wherein said stopper member further has a first end portion, a second end portion opposite to said first end portion in the axial direction, an intermediate section connected between said first and second end portions and extending in the axial direction, and a screw feeding hole having a center aligned with that of said screw-discharging hole in said feeder box in the axial direction, said adjustment slot being formed in said intermediate section of said stopper member.

7. The screw feeding device as claimed in claim 1, wherein said feeder box further has a slide slot formed in said first lateral side surface and extending in the axial direction, said stopper member being disposed movably within said slide slot.

8. A screw feeding device adapted to be disposed in a tool body of a continuous screw driving tool, the tool body extending in an axial direction, said screw feeding device comprising:

a feeder box mechanism adapted to be disposed in the tool body and including a feeder box having a front end surface, a rear end surface, a first lateral side surface, a second lateral side surface opposite to said first lateral side surface, a screw-discharging hole extending rearwardly from said front end surface, and two mounting grooves formed respectively in said first and second lateral side surfaces; and a lock mechanism including a stopper member movable on said first and second lateral side surfaces of said feeder box in the axial direction, two operating members movable respectively within said mounting grooves in said feeder box in a transverse direction perpendicular to the axial direction, and two resilient members each disposed between a respective one of said operating members and said feeder box, said stopper member including two parallel adjustment slots extending in the axial direction and aligned with each other in the transverse direction, each of said adjustment slots having two closed ends opposite to each other in the axial direction, a plurality of large-diameter slot portions arranged in the axial direction, and a plurality of small-diameter slot portions arranged alternately with said large-diameter slot portions and each having a diameter smaller than that of each of said large-diameter slot portions, each of said operating members having a base portion disposed movably within said mounting groove in a respective one of said first and second lateral side surfaces of said feeder box, and an operating protrusion extending through a respective one of said adjustment slots in said stopper member in the transverse direction, said operating protrusion of each of said operating members having a large-diameter protrusion portion and a small-diameter protrusion portion farther from said base portion of a corresponding one of said operating members than said large-diameter protrusion portion, said large-diameter protrusion portion of said operating protrusion of each of said operating members having a diameter no larger than that of each of said large-diameter slot portions of a corresponding one of said adjustment slots and larger than that of each of said small-diameter slot portions of the corresponding one of said adjustment slots, said small-diameter protrusion portion of said operating protrusion of each of said operating members having a diameter smaller than that of said large-diameter protrusion portion of said operating protrusion of a corresponding one of said operating members and no larger than that of each of said small-diameter slot portions of the corresponding one of said adjustment slots, said operating protrusion of each of said operating members being biased by a corresponding one of said resilient members away from said feeder box, each of said operating members being movable relative to said feeder box between a first position whereat said large-diameter protrusion portion of said operating protrusion of a corresponding one of said operating members is disposed within a selected one of said large-diameter slot portions of a corresponding one of said adjustment slots of said stopper member, and a second position whereat said small-diameter protrusion portion of said operating protrusion of the corresponding one of said operating members is disposed in the corresponding one of said adjustment slots of said stopper member.

9. The screw feeding device as claimed in claim 8, wherein each of said mounting grooves in said feeder box has a vertical groove portion and two parallel horizontal groove portions extending respectively from two opposite ends of said vertical groove portion in the transverse direction, said base portion of each of said operating members having a vertical section disposed within said vertical groove portion of a corresponding one of said mounting grooves in said feeder box, and two horizontal sections extending respectively from two opposite ends of said vertical section and disposed respectively within said horizontal groove portions of the corresponding one of said mounting grooves in said feeder box.

10. The screw feeding device as claimed in claim 9, wherein said feeder box further has two receiving holes extending respectively from said vertical groove portions of said mounting grooves in said feeder box in the transverse direction, each of said resilient members being disposed within a respective one of said receiving holes in said feeder box for applying a pushing force to said vertical section of said base portion of a corresponding one of said operating members in the transverse direction.

11. The screw feeding device as claimed in claim 10, wherein each of said resilient members is configured as a coiled compression spring.

12. The screw feeding device as claimed in claim 11, wherein said operating protrusion of each of said operating members further has a connecting portion extending from said large-diameter protrusion portion into a corresponding one of said resilient members in the transverse direction and away from said small-diameter protrusion portion.

13. The screw feeding device as claimed in claim 8, wherein said stopper member further includes two spaced-apart parallel sliding strips extending in the axial direction and having aligned front ends, an abutment block connected between said front ends of said sliding strips, and a screw feeding hole formed through said abutment block and having a center aligned with that of said screw-discharging hole in said feeder box in the axial direction, said adjustment slots being formed respectively in said sliding strips.

14. The screw feeding device as claimed in claim 13, wherein said feeder box further has two slide slots formed respectively in said first and second lateral side surfaces and extending in the axial direction, said sliding strips of said stopper member being disposed respectively and movably within said slide slots.

15. A screw feeding device adapted to be disposed in a tool body of a continuous screw driving tool, the tool body extending in an axial direction, said screw feeding device comprising:

a feeder box mechanism adapted to be disposed in the tool body and including a feeder box having a front end surface, a rear end surface, a first lateral side surface, a second lateral side surface opposite to said first lateral side surface, a screw-discharging hole extending rearwardly from said front end surface, and a mounting groove formed in said first lateral side surface; and a lock mechanism including a stopper member movable on said first lateral side surface of said feeder box in the axial direction, an operating member movable within said mounting groove in said feeder box in a transverse direction perpendicular to the axial direction, and a resilient member disposed between said operating member and said feeder box, said stopper member having an adjustment slot extending in the axial direction, said adjustment slot having two closed ends opposite to each other in the axial direction, a plurality of large-diameter slot portions arranged in the axial direction, and a plurality of small-diameter slot portions arranged alternately with said large-diameter slot portions and each having a diameter smaller than that of each of said large-diameter slot portions, said operating member having a base portion disposed movably within said mounting groove, and an operating protrusion extending through said adjustment slot in said stopper member in the transverse direction, said operating protrusion of said operating member having a large-diameter protrusion portion and a small-diameter protrusion portion farther from said base portion than said large-diameter protrusion portion, said large-diameter protrusion portion having a diameter no larger than that of each of said large-diameter slot portions and larger than that of each of said small-diameter slot portions, said small-diameter protrusion portion having a diameter smaller than that of said large-diameter protrusion portion and no larger than that of each of said small-diameter slot portions, said operating protrusion being biased by said resilient member away from said feeder box, said operating member being movable relative to said feeder box between a first position whereat said large-diameter protrusion portion is disposed within a selected one of said large-diameter slot portions, and a second position whereat said small-diameter protrusion portion is disposed in said adjustment slot;

wherein said mounting groove in said feeder box has a vertical groove portion and two parallel horizontal groove portions extending respectively from two opposite ends of said vertical groove portion in the transverse direction, said base portion of said operating member having a vertical section disposed within said vertical groove portion, and two horizontal sections extending respectively from two opposite ends of said vertical section and disposed respectively within said horizontal groove portions.

16. The screw feeding device as claimed in claim 15, wherein said feeder box further has a receiving hole extending from said vertical groove portion in the transverse direction, said resilient member being disposed within said receiving hole for applying a pushing force to said vertical section of said base portion of said operating member in the transverse direction.

17. The screw feeding device as claimed in claim 16, wherein said resilient member is configured as a coiled compression spring.

18. The screw feeding device as claimed in claim 17, wherein said operating protrusion of said operating member further has a connecting portion extending from said large-diameter protrusion portion into said resilient member in the transverse direction and away from said small-diameter protrusion portion.

* * * * *